United States Patent [19]

Jensen

[11] 4,367,668

[45] Jan. 11, 1983

[54] CIRCULAR SAW ATTACHMENT

[76] Inventor: Joseph D. Jensen, Spokane, Wash. 99203

[21] Appl. No.: 218,630

[22] Filed: Dec. 22, 1980

[51] Int. Cl.[3] ..... B27B 25/08; B27B 27/06

[52] U.S. Cl. ..... 83/415; 83/409; 83/477.2; 83/478; 83/435.1; 83/437

[58] Field of Search ..... 83/478, 477.2, 435.1, 83/437, 409, 415, 419

[56] References Cited

U.S. PATENT DOCUMENTS

| | | | |
|---|---|---|---|
| 1,594,772 | 8/1926 | Fournier | 83/477.2 |
| 2,535,843 | 12/1950 | Curtis | 83/437 X |
| 2,929,419 | 3/1960 | Johnson | 83/435.1 |
| 3,051,204 | 8/1962 | Gaskell | 83/415 X |
| 3,456,541 | 7/1969 | Thompson et al. | 83/415 |
| 3,986,420 | 10/1976 | Huntley et al. | 83/435.1 |
| 4,122,739 | 10/1978 | Marlow | 83/477.2 X |
| 4,206,672 | 6/1980 | Smith | 873/477.2 X |
| 4,219,061 | 8/1980 | Duggins | 83/435.1 X |
| 4,248,115 | 2/1981 | Brodbeck et al. | 83/435.1 |

*Primary Examiner*—James M. Meister

*Attorney, Agent, or Firm*—Graybeal & Uhlir

[57] ABSTRACT

An attachment for circular saws that supports a workpiece for movement past the saw blade. The attachment includes a saw-top plate that is adapted to cover and slide over the saw table surface of the circular saw. A guide on the saw-top plate fits within a groove on the saw table to allow longitudinal translational movement of the attachment. The saw-top plate may be supported on bearing rollers mounted to the saw table. A cut-off guide and a workpiece stop are provided on the saw-top plate that serve to position the workpiece relative to the saw blade. A hold-down device, operating also as a blade guard, is used to hold the workpiece secure on the saw-top plate as it is moved past the blade.

20 Claims, 11 Drawing Figures

FIG 3
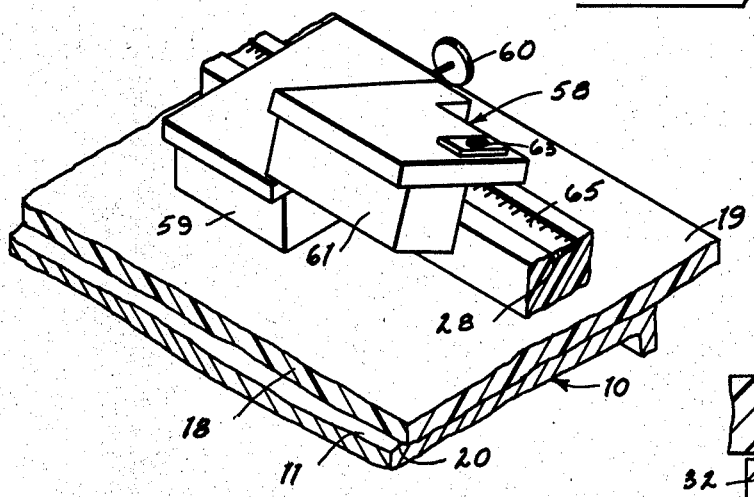
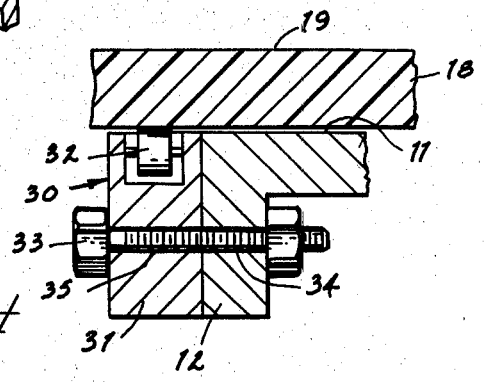
FIG 4
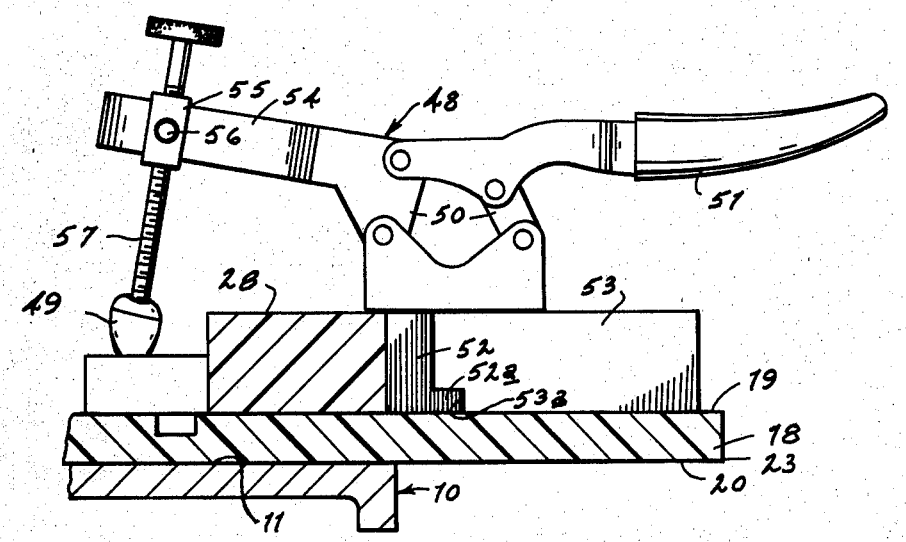
FIG 5

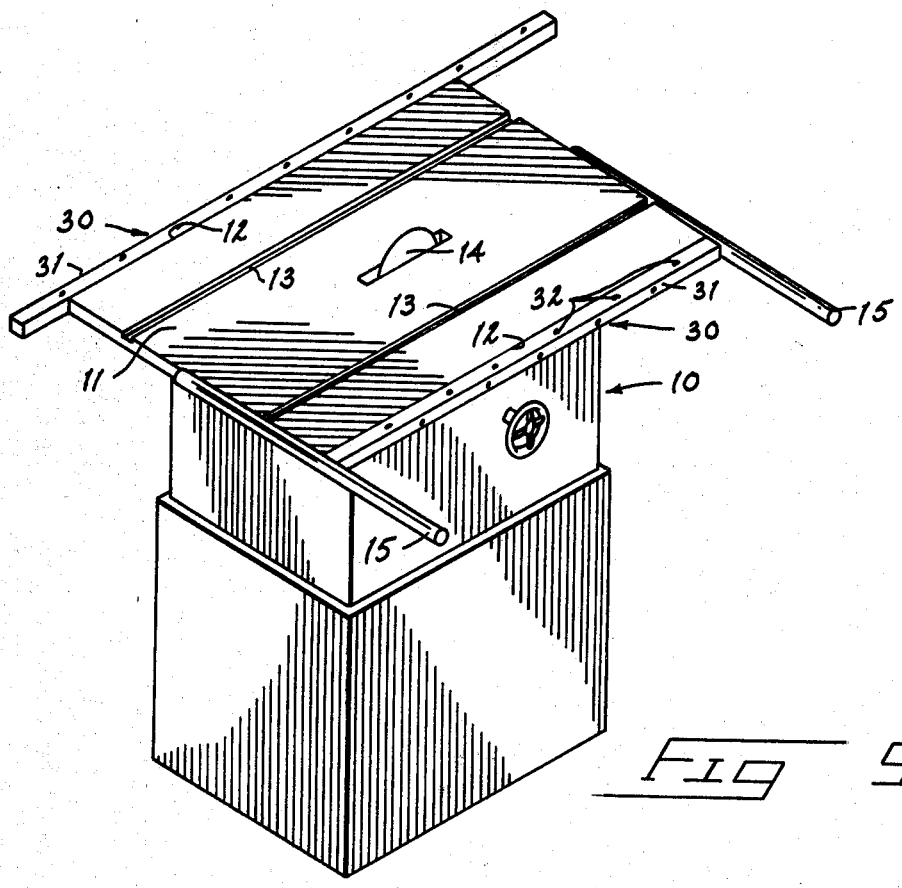
FIG 9
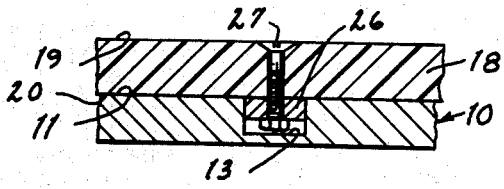
FIG 10
FIG 11
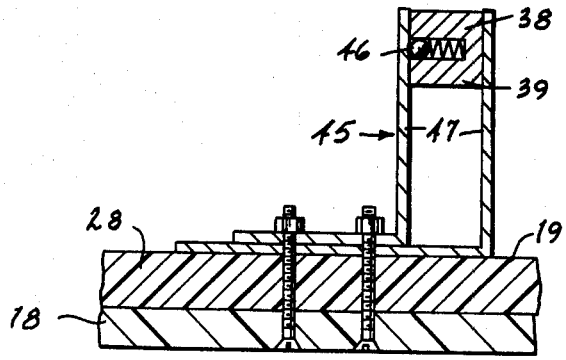

CIRCULAR SAW ATTACHMENT

BACKGROUND OF THE INVENTION

The present invention relates to attachments for circular saws and more particularly to such attachments that mount a workpiece for movement past the circular saw blade.

Circular or "table" saws have been in common use in woodworking, plastics and the light metal industries for many years as a tool for accurately cutting a straight kerf through a workpiece. Circular saws typically include a stationary flat "table" surface on which the workpiece slides. A circular saw blade projects upwardly through the table and is rotated to cut an article as the article is slid into the rotating path of the saw. Various forms of guides are used to hold the workpiece steady as it is pushed across the table and into the path of the blade. Typically two separate forms of guides are used: the rip guide, and the cut-off guide. Both are mounted to the stationary table. The rip guide is oriented transverse to the blade axis and may be secured to the table at a selected distance to one side of the blade. The workpiece is moved on the stationary table and along the rip guide past the blade. The cut-off guide is movably mounted to the table in a longitudinal groove formed in the saw table parallel to the sides of the circular saw blade. A workpiece is held against the cut-off guide and is slid over the stationary table surface past the saw blade.

Both of the above described guides are functional when the workpiece is large enough to be grasped securely by the operator. Small workpieces, however, bring the operator's finger dangerously close to the saw blade. Additionally, small workpieces cannot be easily held against either guide during cutting. Accuracy is sacrificed and safety becomes a substantial problem.

The need therefore exists for some form of attachment for circular saws that will allow safe, accurate cutting of both regular and small size workpieces.

Clamp mechanisms are known that will secure a workpiece to the guide bar of a cut-off guide. The workpiece, however, must still slide along the stationary table top past the saw blade. The clamp is restricted in position on the guide. It must be situated directly above the guide bar in order for two sides of the workpiece to be clamped. Also, the clamp must be released when the workpiece is removed or shifted for a subsequent cut.

The present invention allows fast, accurate and safe cutting of small workpieces by providing positive continuous control of the workpiece during cutting. The workpiece is held relatively stationary against a saw-top plate that moves relative to the stationary saw table. The workpiece is also held against a cut-off guide on the saw-top plate. The workpiece, saw-top plate and cut-off guide are then moved together past the saw blade. The blade is guarded at all times during movement of the present attachment, to continuously protect the operator.

BRIEF DESCRIPTION OF THE DRAWINGS

A preferred form of the present invention is illustrated in the accompanying drawings in which:

FIG. 3 is a fragmented pictorial detail of a stop mechanism for the present invention;

FIG. 4 is an enlarged sectional view taken along line 4—4 in FIG. 1;

FIG. 5 is an enlarged fragmentary view of a clamp mechanism;

FIG. 9 is a pictorial view of a table saw with bearing mechanisms for the present attachment mounted thereto;

FIG. 10 is an enlarged sectional view taken along line 10—10 in FIG. 1; and FIG. 11 is a sectional view taken along line 11—11 in FIG. 8.

DETAILED DESCRIPTION OF A PREFERRED EMBODIMENT

Figure 1:
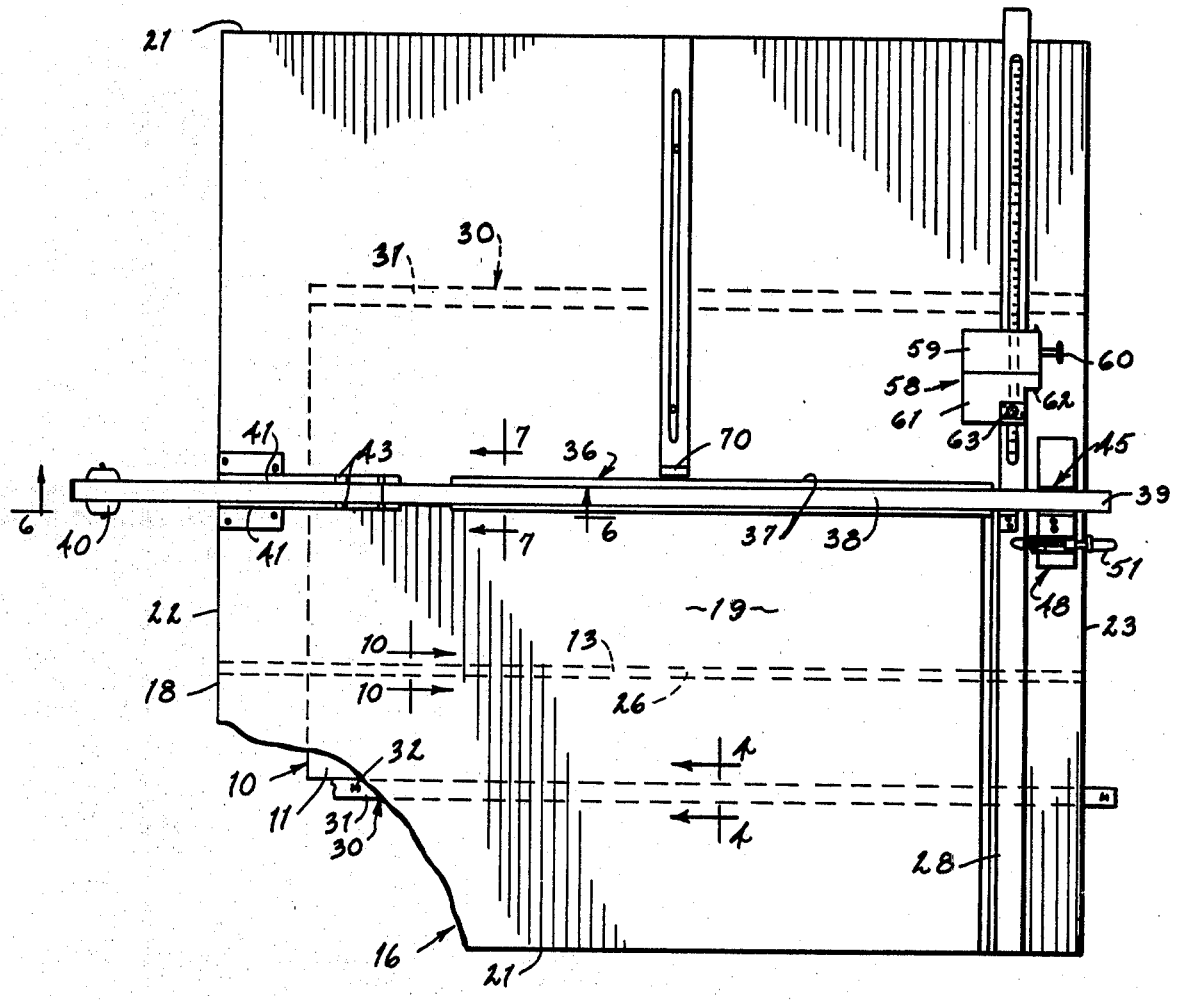
FIG. 1 is a fragmented top plan view of the present attachment, mounted to a circular saw.

The present invention is provided as an attachment for a typical circular table saw 10 generally shown in FIG. 9. The circular or "table saw" 10 typically includes a flat horizontal table top 11. The table 11 is typically rectangular, having parallel longitudinal side edges 12. Table grooves 13 extend parallel to the side edges 12 between transverse ends of the table. The grooves 13 are situated adjacent the circular saw blade 14 that projects up through an opening in the table top. The blade side surfaces are parallel to the groove 13 and table side edges 12. The blade 14 is driven to rotate about a transverse axis. Transverse rip fence supports 15 (FIG. 9) are mounted to the saw at opposed transverse ends of the table. The rip fence supports 15 typically extend beyond one side of the table to allow positioning of a rip fence (not shown) a distance from the blade 14 to facilitate cutting material such as wood, plastic and aluminum.

The present attachment 16 (FIGS. 1 and 2) is adapted to be slidably mounted to the saw table top 11. A basic component of the present attachment 16 is a flat saw-top plate 18 adapted to slidably move over the saw table top 11 relative to the saw blade 14. The plate 18 includes a horizontal flat top surface 19 and a parallel bottom surface 20. The two surfaces are bounded by parallel longitudinal side edges 21 (FIG. 1). The longitudinal side edges are connected by a front end edge 22 and a back end edge 23. The edges 22 and 23 are parallel to each other and transverse to the side edges 21. Preferably, the plate is of sufficient dimension to overlap the entire saw table top 11. However, smaller versions of the present attachment may be used effectively for specialty applications where only very small workpieces are to be cut.

It has been found through experimentation that a transparent synthetic resin plate material can be used effectively for the plate and various other elements attached thereto. However, it is understood that other materials, such as lightweight aluminum alloy may also be used.

Figure 2:
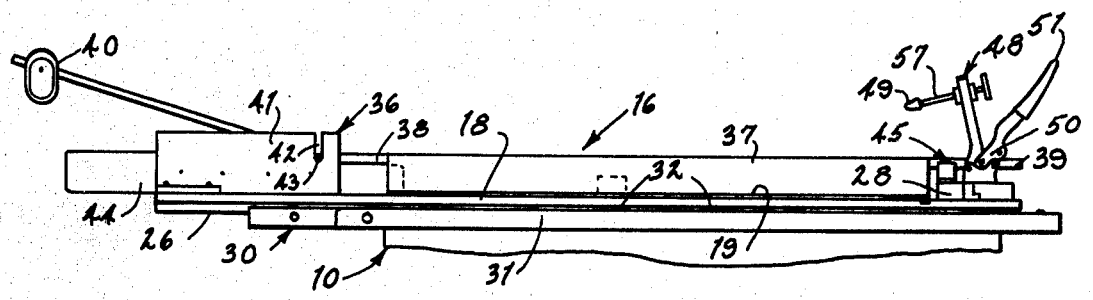
FIG. 2 is a side elevation view of the present attachment and a fragment of the circular saw.

The bottom surface 20 of the saw top plate 18 is provided with a longitudinal guide bar 26 (FIGS. 1, 2 and 10). The bar 26 extends along the bottom surface 20 parallel to the side edges 21 to slidably engage the longitudinal table groove 13. The guide bar 26 controls movement of the plate 18 along the saw table top 11, allowing only translational longitudinal movement thereof. The guide bar 26 may be secured to the plate 18 by appropriate screws 27 (FIG. 10).

It is preferred that the plate 18 be movably supported on the saw table top 11 by a bearing means 30 (FIGS. 4 and 9). The bearing means 30 may be comprised of two or more longitudinal bars 31 mounted to the saw table top 11. Top surfaces of the bars 31 are provided with a number of longitudinally spaced rollers 32. Each of the rollers rotates freely about a transverse axis to engage and support the bottom surface 20 of blade 14. The bars 31 may be mounted by nut and bolt combinations 33 (FIG. 4) to the saw table side edges 12. Apertures 34 are typically provided along the side edges to mount table extensions (not shown). By using longer mounting bolts, both the bars 31 and table extensions can be secured to the saw 10.

The mounting bars 31 are provided with oversized mounting apertures (FIG. 4) to allow elevational adjustment of the bars relative to the top surface of the saw table 11. FIG. 4 illustrates a desirable clearance between the saw table top and plate 18 as determined by the elevational positioning of the rollers 32.

It may be noted in FIGS. 1 and 9 that one of the bars 31 is substantially longer than the other. The longer bar is provided to increase stability of the table when it is moved longitudinally to extreme positions past one end or the other of the saw table top 11. The shorter bar 31 extends the length of the opposite table side edge, its length being restricted by lateral projections of the rip fence supports 15.

On small versions of the present attachment, it is conceivable that the saw-top plate 18 could rest directly against the saw table top 11. The smaller plate would present less frictional resistance to sliding movement than the heavier, full size version shown in the drawings. Therefore, smaller versions of the present attachment may be provided without bearing means 30 or with the bearing means provided as an option.

A cut-off guide 28 is mounted to the top surface 19 of plate 18. The cut-off guide 28 is situated adjacent the back end 23 and is perpendicular to the guide bar 26. The cut-off guide is provided to hold a workpiece in a position preferably perpendicular to the saw blade as it is moved with the present attachment 16 past the blade 14.

The cut-off guide 28 preferably extends to opposite sides of the saw blade 14 across the full width of the plate 18 from one side edge 21 to the other. This enables workpieces to be held securely on both sides of the saw blade 14.

An important feature of the present invention is a combined blade guard and hold-down means 36. Means 36 is mounted to the saw-top plate 18 and extends longitudinally from the front end 22 toward the back end 23. Means 36 is positioned on the plate 18 to straddle the saw blade 14 and cover it during cutting operations. The blade 14 is covered by means 36 regardless of the saw-top table position on the circular saw. The means 36 is vertically adjustable to receive and secure a workpiece in position against the top surface of the plate 18.

Figure 6:
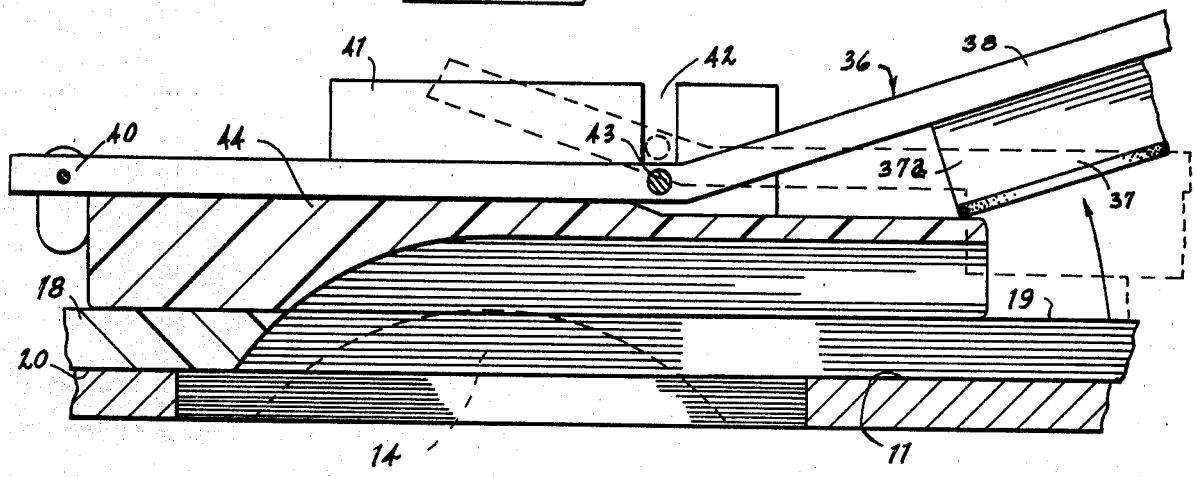
FIG. 6 is an enlarged fragmentary sectional view taken along line 6—6 in FIG. 1.
Figure 7:
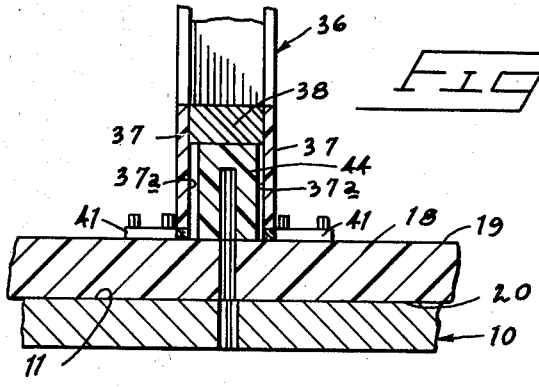
FIG. 7 is an enlarged section view taken along line 7—7 in FIG. 1.

Means 36 is comprised in part of a pair of parallel upright walls 37 (FIGS. 1, 2 and 7). The walls 37 are elongated and oriented longitudinally over the top surface 19 of the plate 18. The walls 37 are positioned in relation to the plate 18 to be situated on opposite sides of the saw blade. Each wall 37 thus includes an inwardly facing wall surface **37*a* that faces a side of the saw blade. Bottom edges of the walls 37 may be provided with a resilient padding material (FIG. 6) that, when engaged against a workpiece, will deform slightly and conform to the workpiece configuration. Additionally, the padding material offers high frictional resistance to lateral movement of the workpiece on the plate 18**.

The walls 37 are mounted to a longitudinal rigid bar 38 extending from a handle end 39 to a weighted end 40. The handle end 39 is situated above the back saw-top table edge 23 of the plate 18 and the weighted end 40 projects forwardly of the front saw-top table end 22. The bar 38 pivotably mounts the walls 37 to the plate 18 both for pivotal movement about a transverse horizontal axis and for vertical elevational movement.

A pair of brackets 41 (FIGS. 1, 2 and 6) are attached to the plate 18 near its front end 22. Each bracket 41 includes an upwardly open vertical slot 42. The slots 42 are aligned transversely to receive a pin 43 that extends through the bar 38. The pin 43 and slots 42 allow pivotal motion of the walls and bar about the pin axis. They also allow vertical movement of the walls as the pin 43 is allowed to slide elevationally within the confines of the slots 42.

The walls 37, shown in solid lines in FIG. 6, are pivoted about the pin 43 axis to a material receiving position, to allow access for placement or removal of a workpiece. The walls 37 are also shown by dashed lines in FIG. 6, pivoted to a down holding position against a workpiece. The corresponding position of the pin 43 in the slots 42 is also shown by dashed lines. The pin 43 thus slides vertically in the slots to accomodate workpieces of various thicknesses to assure firm, complete engagement of the bottom wall edges along the full length of the workpiece top.

The brackets 41 mount a closed cover 44 (FIGS. 6 and 7) that is slotted to receive and cover the blade at the extreme back position of the attachment. This position is illustrated in FIG. 6, in which the blade is shown in dashed lines.

The handle end 39 of bar 38 is releasably secured to the table by an upright bracket assembly 45 (FIGS. 1 and 11). The bracket assembly 45 includes transversely spaced upright flanges 47 that slidably engage complementary sides of the bar 38 when the hold down means 36 is in the down holding position. A spring biased ball 46 may be provided in the bar to frictionally engage one of the walls 47 to releasably hold the bar in position. The ball 46 and bracket assembly 45 thus serve to secure the walls at selected positions elevationally and also prevent transverse motion thereof.

A clamp means 48 may be provided on the plate 18 adjacent the cut-off guide 28. The clamp means 48 is adapted to secure a workpiece against the top surface 19 of the saw-top plate 18 and the cut-off guide 28. The clamp means 48 thus augments the clamping function of blade guard and hold down means 36. The clamp means 48 provides a clamp pad 49 adapted to yieldably engage and press against the workpiece. The pad 49 is mounted through a toggle linkage 50 to an operator handle 51. Pivotal movement of the handle moves the pad 49 from an inoperative position as shown in FIG. 2 to an operative position as shown in FIG. 5.

The clamp pad 49 is adjustably mounted to an elongated clamp arm 54. A yolk 55 and set screw 56 (FIG. 5) facilitate longitudinal positioning of the pad 49 relative to the cut-off guide 28. Adjustment of the clamp pad vertically on its threaded shaft 57 allows for securing workpieces of various thicknesses. Also, longitudinal positioning of the pad 49 along the arm 54 can be accomplished to accomodate wider workpieces simply by turning the shaft 57 or selectively loosening the set screw 56, then sliding the shaft and pad to a selected position. Neither operation requires tools of any sort.

The clamp means is also provided with a base 52 (FIG. 5) slidably mounted by a bracket 53 to the plate. The base 52 has a lip 52*a* that is received for sliding movement in a channel 53*a* on the bracket 53 to enable lateral positioning of the clamp means to opposite sides of the blade guard and hold-down means 36.

A workpiece stop means 58 is provided along the length of the cut-off guide 28 to abut the workpiece at a selected lateral position relative to the saw blade. The workpiece stop means 58 includes a slide base 59 slidably mounted along the cut-off guide 28. A set screw 60 is threadably engaged with the base 59 to be selectively set against the guide 28. The base 59 can therefore be secured in a stationary position at any selected lateral position along the guide 28.

Figure 8:
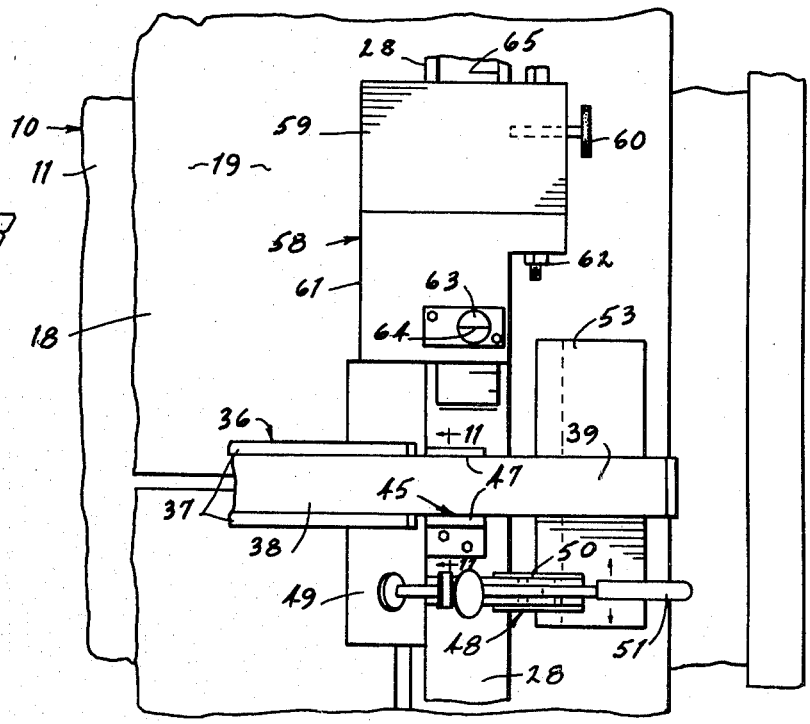
FIG. 8 is an enlarged fragmentary top plan view of the stop mechanism and adjacent elements.

An abutment plate 61 is mounted to the slide base 59 by a pivot pin 62 (FIG. 8). The axis of the pin is transverse to the guide bar 26 and is situated rearwardly of the cut-off guide 28. A magnifier 63 may be provided on the abutment plate directly over an indicator (line) 64 to facilitate visual reading of the lateral distance from the blade to the stop. Such a distance is read on a scale 65 secured to an upper surface of the cut-off guide 28. The scale 65 is marked with standard dimensional gradations that, when aligned with the indicator, display the lateral distance from the blade to the stop.

The abutment plate 61 is pivoted to the slide base 59 so it may be selectively pivoted out of the way during cutting operations. This frees the end of the workpiece which could otherwise bind against the saw blade and create a hazardous situation.

Prior to operation, the present attachment is mounted to a circular saw with the guide bar 26 slidably engaging the table groove 13. The plate surface 20 will then rest on the previously installed rollers 32. If the rollers 32 are not used, the surface 20 will slidably engage the flat top surface of the saw table 11.

If the attachment 16 is being installed for the first time, the saw blade 14 is initially lowered below the saw top 11. Then, when the attachment 16 has been positioned on the saw table top, the saw is started and the blade is gradually raised. The raising blade cuts its way upwardly through the plate material. When the blade 14 is through the plate 18 a slit is formed longitudinally along the plate between the ends 22 and 23.

The cutting operation is quickly and easily accomplished simply by placing a workpiece against the cut-off guide and sliding it laterally until it engages the abutment plate 61 (previously positioned along the cut-off guide). The blade guard and hold-down means 36 is then lowered to engage the workpiece and hold it in position during the cutting operation. The pads along the lower edges of the guard walls 37 frictionally engage and press gravitationally to hold the workpiece against the top surface 19 of the plate.

If desired, the clamp means can be operated to further secure the workpiece against the cut-off guide and plate. This is done by adjusting the pad 49 to engage and compress against the workpiece when the handle 51 is moved to the operative position (see FIG. 5).

When the workpiece is in position, the abutment plate 61 is pivoted upwardly (FIG. 3) to clear the workpiece end. The saw is then started and the entire attachment and the clamped workpiece are moved together over the saw table 10 to bring the workpiece into the path of the saw blade 14. The blade 14 will cut through the workpiece material, leaving a piece cut to size on one side of the blade and the remainder of the workpiece on the other side. The two pieces are held securely by the pads along the walls 37 of the combined blade guard and hold-down means 36. When the workpiece is cut through, the attachment is drawn back to the original starting position and the saw is stopped. The walls 37 can then be elevated and the clamp released to allow access to the cut sections of the workpiece.

It might be understood that the cut-off action described above can be repeated in quick succession to cut a series of workpieces to identical lengths. This is accomplished quickly and accurately. The operator is not required to hold the workpiece during the cutting operation, since the saw blade is covered continuously during the operation.

The present attachment is also extremely useful in producing multiple cuts through a plurality of workpieces. In this situation, an additional stop 70 (FIG. 1) may be provided on the top surface of the plate. The stop 70 is situated forwardly of the stop means 58 and can be selectively positioned by set screws or other appropriate fasteners to match the spacing from the blade to determine the selected depth of a cut. Several workpieces can then be set against the two stops, one abutting the other, with the horizontal stack braced against the cut-off guide. The longitudinal walls and the pads along the lower edges thereof will engage and rest against each of the several workpieces, holding securely while the cut is being made.

The above description and attached drawings are given by way of example to set forth a preferred form of the present invention. Other forms may be envisioned that fall within the scope of the following claims.

What I claim is:

1. A cut-off attachment for use in combination with a stationary saw table having an upwardly projecting circular saw blade, said cut-off attachment being especially designed for the cutting of small workpieces and comprising:

a saw-top plate mounted to move over the table in guided, longitudinal fashion, and having a longitudinally extending, saw blade receiving slot of essentially saw blade width, through which the saw blade projects;

a blade guard and workpiece holddown means arranged to completely cover and closely surround the projecting portion of the saw blade while the saw-top plate is moved with respect to the saw blade when workpieces are being cut and while the workpieces are being placed on or removed from the saw-top plate between cuts, said blade guard and workpiece holddown means including a fixed portion surrounding the exposed portion of the saw blade when the saw-top plate is in its rearmost position with respect to the saw table and a movable, vertically floating portion comprising a workpiece engaging portion and including top and side wall means the lower edges of which are engageable with the saw top plate or with workpieces thereon along lines closely alongside and parallel to the saw blade receiving slot throughout the extent of travel of the slot relative to the saw blade during cutting, such engagement being maintained during cutting essentially only by the weight of the movable, vertically floating portion of the blade guard and workpiece holddown means; and cut-off guide means on the saw-top plate at the rear end thereof and extending to opposite sides of the blade.

2. An attachment as in claim 1, further comprising independently actuatable clamp means on the saw-top plate adjacent the cut-off guide for securing workpieces against the top surface of the saw-top plate and cut-off guide.

3. An attachment as in claim 1, further comprising a bracket slidably mounting the clamp means to the saw-top plate for transverse sliding movement, adapted to allow positioning of the hold-down means to opposite sides of the saw blade.

4. An attachment as in claim 1 or claim 2, wherein the said side walls of the blade guard and workpiece hold-down means are fabricated of transparent synthetic resin.

5. An attachment as in claim 1, wherein resilient padding material is arranged along the bottom edges of the side walls of the blade guard and workpiece holddown means which, when engaged against a workpiece on the saw-top plate, offers high frictional resistance to lateral movement of the workpiece during cutting.

6. An attachment according to claim 1, further comprising roller means between the saw table top and the bottom of the saw-top plate facilitating relative movement therebetween.

7. An attachment as in claim 1 or claim 2, further comprising selectively adjustable stop means slidably mounted to the cut-off guide, for abutment with a workpiece and adapted to position the workpiece in a selected lateral position relative to the blade.

8. An attachment as in claim 1 or claim 2, wherein the cut-off guide includes a linear measure scale and wherein the adjustable stop means slides over the scale and includes an indicator adjacent the scale adapted to visually indicate the linear distance from the saw blade to the stop means.

9. A cut-off attachment for use in combination with a horizontal saw table having an upwardly projecting circular saw blade, and longitudinal side edges and a longitudinal guide groove parallel with the side edges of the circular saw blade, said cut-off attachment being especially designed for the cutting of small workpieces and comprising:

a saw-top plate adapted to move longitudinally over the table and having parallel flat top and bottom surfaces between transverse front and rear ends, and having a longitudinal slot through which the saw blade projects with the sides of the slot being in close proximity to the sides of the saw blade;

a guide bar on the bottom surface of the saw-top plate adapted to be slidably received within the table guide groove for guiding motion of the saw-top plate over the saw table in a translational longitudinal path;

a blade guard and workpiece holddown means longitudinally spanning the saw blade receiving slot and arranged to completely cover and closely surround the projecting portion of the saw blade during movement of the saw-top plate with respect to the saw blade when workpieces are being cut, said blade guard and workpiece holddown means including a top bar longitudinally spanning the saw-top plate and retainable thereon by vertically slotted bracket means upstanding from the front portion of the saw-top plate, with a pivot pin extending transversely of the top bar and vertically movable within the slotted portions of said bracket means, the blade guard and workpiece holddown means being also retainable on the saw-top plate by a bracket assembly upstanding from the rear portion of the saw-top plate, into which the rear end of the top bar is engageable and frictionally retained when workpieces are being cut by the saw blade, said blade guard and workpiece holddown means further including parallel side walls extending below said top bar and having straight bottom edges engageable with workpieces on the saw-top plate along lines closely alongside the saw blade and saw blade receiving slot, and a cut-off guide on the top surface of the saw-top plate at the rear end thereof adapted to extend to opposite sides of the blade.

10. An attachment as in claim 7, further comprising independently actuatable clamp means on the saw-top plate adjacent the cut-off guide adapted to secure a workpiece against the top surface of the saw-top plate and cut-off guide.

11. An attachment as in claim 10, further comprising a bracket slidably mounting the clamp means to the saw-top plate for transverse sliding movement, adapted to allow positioning of the hold-down means to opposite sides of the saw blade.

12. An attachment as in claim 9, wherein the pivot pin in the top bar of said blade guard and workpiece hold-down means is at a position near but somewhat inboard to the rear edge of the saw-top plate and the top bar thereof is configured to have forward and rear leg portions in obtuse angle relation centered on said pivot means, and counterweight means mounted at the end of the forwardly directed leg portion of the top bar of sufficient weight to normally hold the other, rearwardly directed leg portion of the blade guard and workpiece holddown means up off the saw-top plate when the rear end of the top bar is disengaged from the rear bracket assembly, to facilitate placement and removal of workpieces onto and off the saw-top plate.

13. An attachment as in claim 9, wherein the said side walls of the blade guard and workpiece holddown means are fabricated of transparent synthetic resin.

14. An attachment as in claim 1 or claim 13, wherein resilient padding material is arranged along the bottom edges of the side walls of the blade guard and workpiece holddown means which, when engaged against a workpiece, deforms slightly and offers high frictional resistance to lateral movement of the workpiece on the saw-top plate during cutting.

15. An attachment according to claim 9, further comprising roller means between the saw table top and the bottom of the saw-top plate facilitating relative movement therebetween.

16. An attachment as in claim 9, wherein the saw blade receiving slot has been cut in the saw top plate by the saw blade when the attachment is first installed on the saw table.

17. An attachment as in claim 9, wherein the vertically extending slots in the forwardly placed bracket means, and in which the transverse pivot pin in the top bar moves, are upwardly open so that the blade guard and workpiece holddown means when in workpiece engaging position is able to fully engage its bottom wall edges with the workpiece and can accommodate to various workpiece thicknesses, with the extent of pressure of the blade guard and holddown means against a workpiece being essentially only that occasioned by the weight of the movable portions of the blade guard and workpiece holddown means.

18. An attachment as in claim 9, wherein said blade guard and workpiece holddown means further comprises a closed cover fixedly mounted on said saw-top plate over and around the forward end of the saw blade receiving slot in the saw-top plate, and serving to cover the saw blade when the saw-top plate is in its extreme rearward position on the saw table and the top bar of the blade guard and holddown means is pivoted upwardly at the front thereof for workpiece placement on or removal from the saw-top plate.

19. An attachment as in claim 9, further comprising selectively adjustable stop means slidably mounted to the cut-off guide, for abutment with a workpiece and adapted to position the workpiece in a selected lateral position relative to the blade.

20. An attachment as in claim 9, wherein the cut-off guide includes a linear measure scale and wherein the adjustable stop means slides over the scale and includes an indicator adjacent the scale adapted to visually indicate the linear distance from the saw blade to the stop means.

* * * * *